US009077120B2

(12) United States Patent
Zhang

(10) Patent No.: US 9,077,120 B2
(45) Date of Patent: Jul. 7, 2015

(54) ELECTRICAL CONNECTOR

(71) Applicant: HON HAI PRECISION INDUSTRY CO., LTD., New Taipei (TW)

(72) Inventor: Zhi-Cheng Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 9 days.

(21) Appl. No.: 14/105,590

(22) Filed: Dec. 13, 2013

(65) Prior Publication Data

US 2014/0179163 A1 Jun. 26, 2014

(51) Int. Cl.

| | |
|---|---|
| ***H01R 24/64*** | (2011.01) |
| ***H01R 13/66*** | (2006.01) |
| *H01R 25/00* | (2006.01) |

(52) U.S. Cl.

CPC ..... *H01R 13/6658* (2013.01); *H01R 24/64* (2013.01); *H01R 25/006* (2013.01)

(58) Field of Classification Search

CPC ..... H01R 24/64; H01R 13/6658

See application file for complete search history.

(56) References Cited

U.S. PATENT DOCUMENTS

| | | | | |
|---|---|---|---|---|
| 6,497,588 | B1 * | 12/2002 | Scharf et al. | 439/607.38 |
| 6,522,151 | B2 * | 2/2003 | Armistead et al. | 324/538 |
| 6,540,564 | B1 * | 4/2003 | Ko | 439/676 |
| 6,541,878 | B1 * | 4/2003 | Diab | 307/17 |
| 6,881,096 | B2 * | 4/2005 | Brown et al. | 439/620.01 |
| 6,926,558 | B2 * | 8/2005 | Sasai et al. | 439/620.04 |
| 7,018,242 | B2 * | 3/2006 | Brown et al. | 439/676 |
| 7,123,117 | B2 | 10/2006 | John et al. | |
| 7,241,181 | B2 | 7/2007 | Machado et al. | |
| 7,367,851 | B2 * | 5/2008 | Machado et al. | 439/676 |
| 7,416,442 | B1 * | 8/2008 | Liu | 439/540.1 |
| 7,575,478 | B1 * | 8/2009 | Wei | 439/620.11 |
| 7,661,994 | B2 * | 2/2010 | Machado et al. | 439/676 |
| 7,670,183 | B2 * | 3/2010 | Huang et al. | 439/620.05 |
| 7,708,594 | B2 * | 5/2010 | Xu | 439/620.05 |
| 7,708,595 | B2 * | 5/2010 | Chow et al. | 439/620.15 |
| 7,712,941 | B2 * | 5/2010 | Tai et al. | 362/581 |
| 7,717,749 | B2 * | 5/2010 | Chen et al. | 439/620.22 |
| 7,749,027 | B2 * | 7/2010 | Chow et al. | 439/620.15 |
| 7,786,009 | B2 * | 8/2010 | Machado et al. | 438/676 |
| 7,841,902 | B2 * | 11/2010 | Chow et al. | 439/620.15 |
| 7,843,300 | B2 * | 11/2010 | Wang et al. | 336/192 |
| 7,845,984 | B2 * | 12/2010 | Schaffer et al. | 439/620.18 |

(Continued)

FOREIGN PATENT DOCUMENTS

| | | |
|---|---|---|
| TW | M437561 | 9/2012 |

*Primary Examiner* — Ross Gushi

(74) *Attorney, Agent, or Firm* — Ming Chieh Chang; Wei Te Chung

(57) ABSTRACT

An electrical connector (10) includes plural pairs of mating terminals (24), plural pairs of foot terminals (26), and a number of circuit board component units. The circuit board component unit includes an upper inner circuit board (141), a lower inner circuit board (142), and a number of electronic components mounted onto the upper and lower inner circuit board (141,142). The electronic components include a number of transformers (15), each transformer (15) including a drum type core (161), a primary winding wire (171), and a secondary winding wire (172) wound around the drum type core (161). The primary winding wire (171) of one transformer (15) and the primary winding wire (171) of an adjacent transformer (15) or the secondary winding wire (172) of the one transformer (15) and the secondary winding wire (172) of the adjacent transformer (15) are disposed adjacent to each other to prevent electric discharge.

20 Claims, 11 Drawing Sheets

(56) References Cited

U.S. PATENT DOCUMENTS

| | | | | |
|---|---|---|---|---|
| 7,863,776 | B2 * | 1/2011 | Togami et al. | 307/104 |
| 7,896,672 | B2 * | 3/2011 | Felisilda De La Cruz | 439/188 |
| 7,944,668 | B2 * | 5/2011 | Huang et al. | 361/111 |
| 7,959,473 | B2 * | 6/2011 | Machado et al. | 439/676 |
| 8,118,619 | B2 * | 2/2012 | Schaffer et al. | 439/676 |
| 8,147,278 | B2 * | 4/2012 | Renteria et al. | 439/676 |
| 8,152,567 | B2 * | 4/2012 | Wu et al. | 439/620.06 |
| 8,162,695 | B2 * | 4/2012 | Zhang et al. | 439/620.22 |
| 8,203,418 | B2 * | 6/2012 | Harrison et al. | 336/200 |
| 8,206,019 | B2 * | 6/2012 | Chen et al. | 362/581 |
| 8,206,183 | B2 * | 6/2012 | Machado et al. | 439/676 |
| 8,251,744 | B2 * | 8/2012 | Huang et al. | 439/607.01 |
| 8,272,898 | B2 * | 9/2012 | Chow et al. | 439/620.15 |
| 8,333,599 | B2 * | 12/2012 | Xu et al. | 439/76.1 |
| 8,337,246 | B2 * | 12/2012 | Zhang | 439/607.01 |
| 8,449,332 | B2 * | 5/2013 | Purkis et al. | 439/620.18 |
| 8,454,382 | B2 * | 6/2013 | Zhang et al. | 439/540.1 |
| 8,475,213 | B2 * | 7/2013 | Wang et al. | 439/620.05 |
| 8,480,440 | B2 * | 7/2013 | Machado et al. | 439/676 |
| 8,529,296 | B2 * | 9/2013 | Lee et al. | 439/620.07 |
| 8,535,100 | B2 * | 9/2013 | Ge et al. | 439/620.17 |
| 8,545,274 | B2 * | 10/2013 | Purkis et al. | 439/668 |
| 8,579,660 | B2 * | 11/2013 | Chow et al. | 439/607.01 |
| 8,579,661 | B2 * | 11/2013 | Zhang | 439/607.01 |
| 8,591,261 | B2 * | 11/2013 | Das et al. | 439/620.05 |
| 8,636,540 | B2 * | 1/2014 | Bu | 439/490 |
| 8,636,545 | B2 * | 1/2014 | Chow et al. | 439/607.27 |
| 8,678,857 | B2 * | 3/2014 | Zhang et al. | 439/541.5 |
| 8,764,493 | B2 * | 7/2014 | Renteria et al. | 439/676 |
| 8,882,546 | B2 * | 11/2014 | Machado et al. | 439/676 |
| 2002/0155758 | A1 * | 10/2002 | Wang | 439/620 |
| 2005/0020148 | A1 * | 1/2005 | Peng et al. | 439/894 |
| 2008/0305680 | A1 * | 12/2008 | Little et al. | 439/541.5 |
| 2008/0305692 | A1 * | 12/2008 | Little et al. | 439/676 |
| 2011/0053418 | A1 * | 3/2011 | Margulis et al. | 439/620.07 |
| 2012/0115362 | A1 * | 5/2012 | Zhang | 439/607.35 |
| 2012/0176756 | A1 * | 7/2012 | Gailus et al. | 361/752 |
| 2012/0315794 | A1 * | 12/2012 | Chen et al. | 439/620.07 |
| 2013/0045643 | A1 * | 2/2013 | Hu et al. | 439/676 |
| 2013/0288526 | A1 * | 10/2013 | Rascon et al. | 439/607.35 |
| 2014/0045374 | A1 * | 2/2014 | Tang et al. | 439/569 |
| 2014/0045380 | A1 * | 2/2014 | Chen | 439/620.15 |
| 2014/0170904 | A1 * | 6/2014 | Tang et al. | 439/620.23 |
| 2014/0179163 | A1 * | 6/2014 | Zhang | 439/620.15 |
| 2014/0194009 | A1 * | 7/2014 | Zhang | 439/676 |
| 2014/0206226 | A1 * | 7/2014 | Zhang et al. | 439/541.5 |
| 2014/0308849 | A1 * | 10/2014 | Hsu et al. | 439/607.55 |
| 2014/0320233 | A1 * | 10/2014 | Wei | 333/32 |
| 2014/0322931 | A1 * | 10/2014 | Wei | 439/55 |
| 2014/0342608 | A1 * | 11/2014 | Wu et al. | 439/607.35 |
| 2014/0349519 | A1 * | 11/2014 | Gao et al. | 439/607.01 |
| 2014/0349525 | A1 * | 11/2014 | Gutierrez et al. | 439/722 |
| 2014/0377996 | A1 * | 12/2014 | Renteria et al. | 439/620.21 |
| 2015/0003032 | A1 * | 1/2015 | Edwards et al. | 361/818 |
| 2015/0004849 | A1 * | 1/2015 | Caveney et al. | 439/676 |
| 2015/0056824 | A1 * | 2/2015 | Bolouri-Saransar et al. | 439/64 |
| 2015/0056825 | A1 * | 2/2015 | Hsu et al. | 439/78 |
| 2015/0056826 | A1 * | 2/2015 | Gao et al. | 439/78 |

* cited by examiner

ELECTRICAL CONNECTOR

BACKGROUND OF THE INVENTION

1. Field of the Invention

The present invention relates to an electrical connector, and more particularly to an electrical connector having a plurality of transformers disposed in an internal circuit board.

2. Description of Prior Arts

U.S. Pat. No. 7,241,181 issued to Machado et al. on Jul. 10, 2007 discloses a connector assembly incorporating an insert assembly disposed in the rear portion of the connector housing. The insert assembly includes a substrate adapted to receive one or more electronic components such as transformers, common mode chokes, or other signal conditioning elements or magnetics. The transformer includes a toroidal core, a primary coil, and a secondary coil. The primary coil and the secondary coil are wound around the toroidal core. Taiwan Utility Model No. 437561 discloses use of surface mount pulse transformers and surface mount chokes in a related connector assembly.

An electrical connector having surface mount transformers arranged in a simple construction is desired.

SUMMARY OF THE INVENTION

An electrical connector includes: plural pairs of mating terminals, each pair of mating terminals acting as an end of each differential signal channel, said mating terminals used for mating with a plug along a longitudinal direction; plural pairs of foot terminals, each pair of foot terminals acting as the other end of each differential signal channel; a plurality of circuit board component units interconnecting said mating terminals and said foot terminals. The circuit board component unit includes an inner circuit board and a number of electronic components mounted onto the inner circuit board, said electronic components including a number of transformers. Each transformer includes a drum type core, the drum type core including a core and first and second flanges disposed on both ends of the core, a primary winding wire and a secondary winding wire wound around the core, a number of first terminal electrodes each formed on respective surface of the first and second flanges at a lateral side of the drum type core, the primary winding wire including two ends and an intermediate tap each extending to the first terminal electrode, a number of second terminal electrodes each formed on respective surface of the first and second flanges at the other lateral side of the drum type core, the secondary winding wire including two ends and an intermediate tap each extending to the second terminal electrode. The transformers disposed in a first surface of the inner circuit board and aligned along the longitudinal direction, the drum type core extending along a transverse direction perpendicular to the longitudinal direction, either said first terminal electrodes of one transformer and said first terminal electrodes of an adjacent transformer or said second terminal electrodes of the one transformer and said second terminal electrodes of the adjacent transformer being disposed adjacent to each other.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
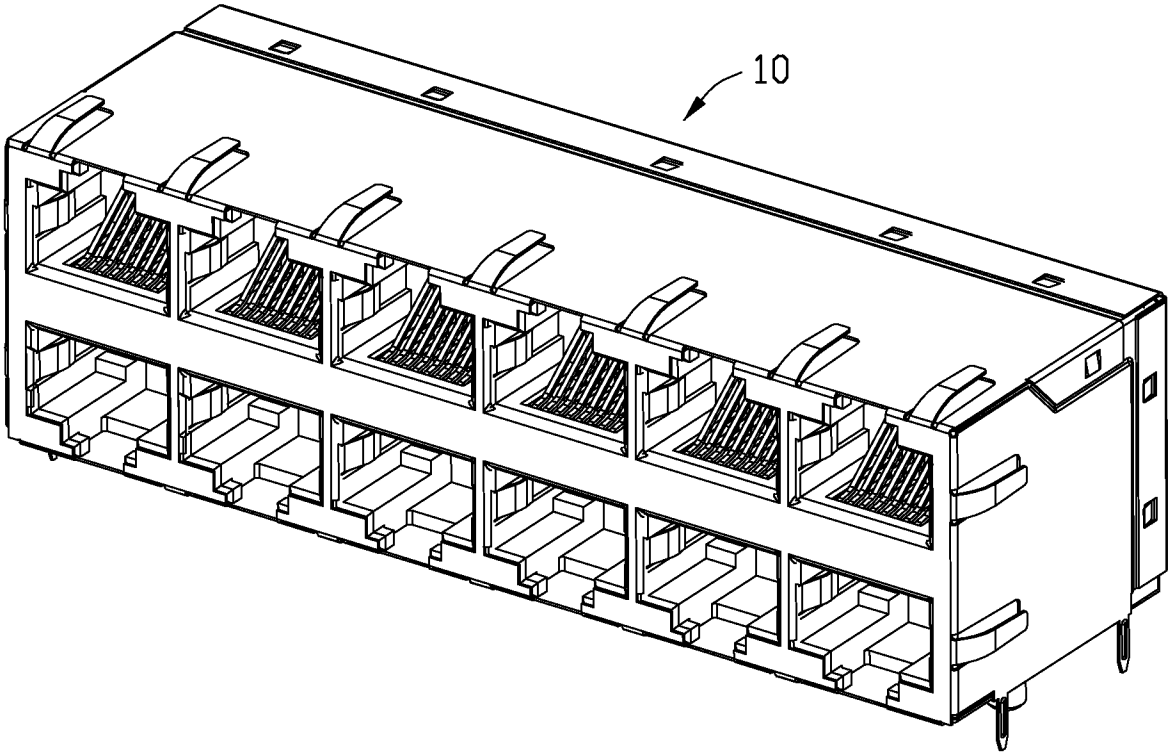
FIG. 1 is a perspective view of an electrical connector in accordance with the present invention.

Reference will now be made to the drawing figures to describe the present invention in detail.

Figure 2:
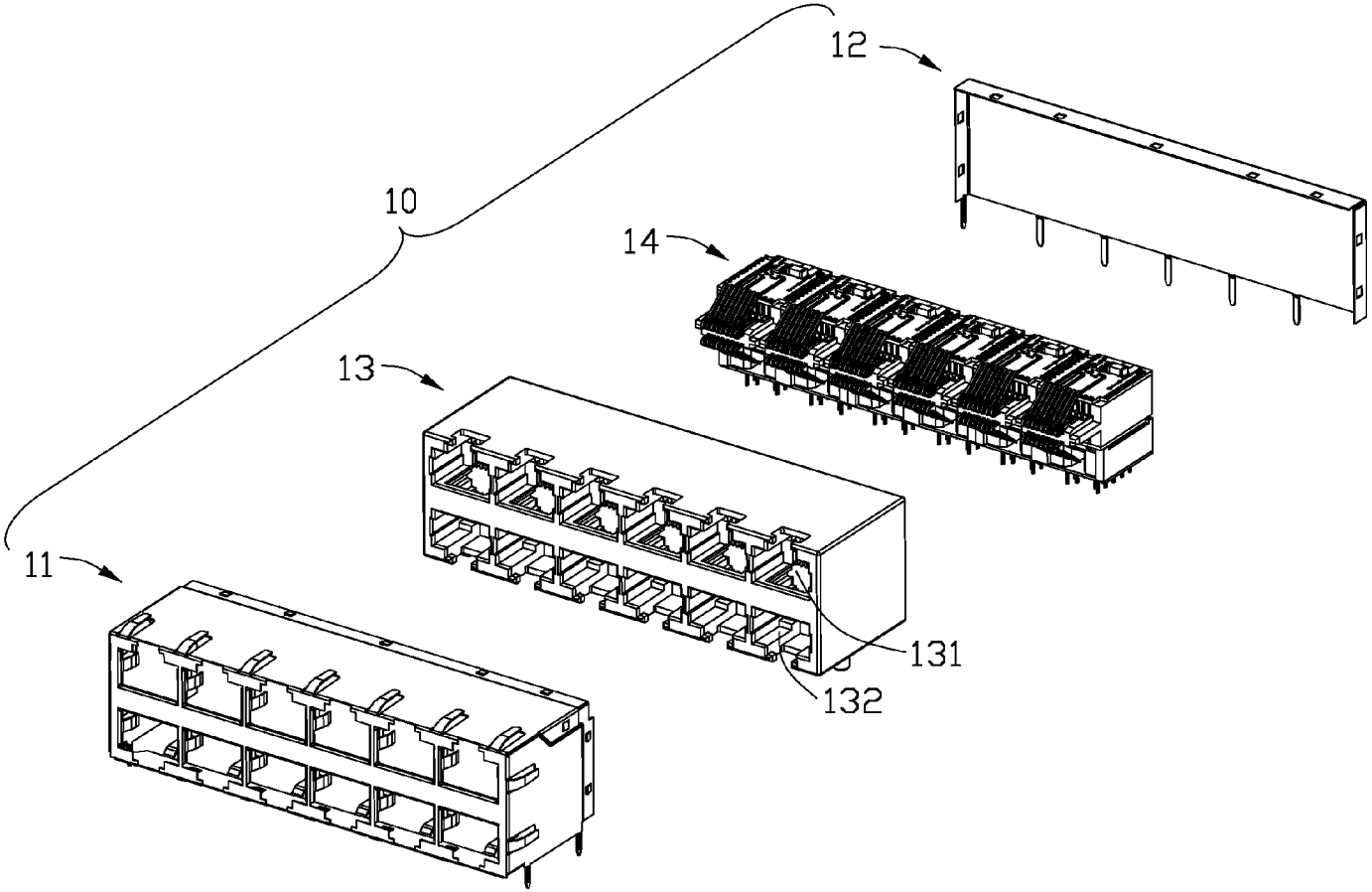
FIG. 2 is an exploded view of the electrical connector as shown in FIG. 1.
Figure 3:
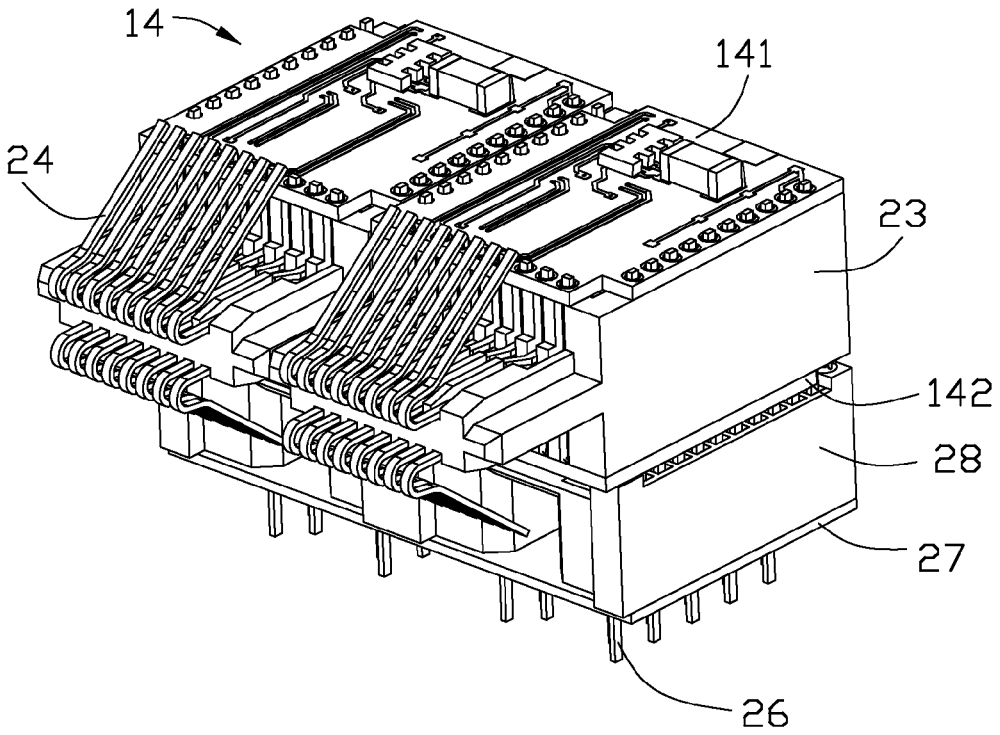
FIG. 3 is a perspective view of a terminal module in FIG. 2.
Figure 4:
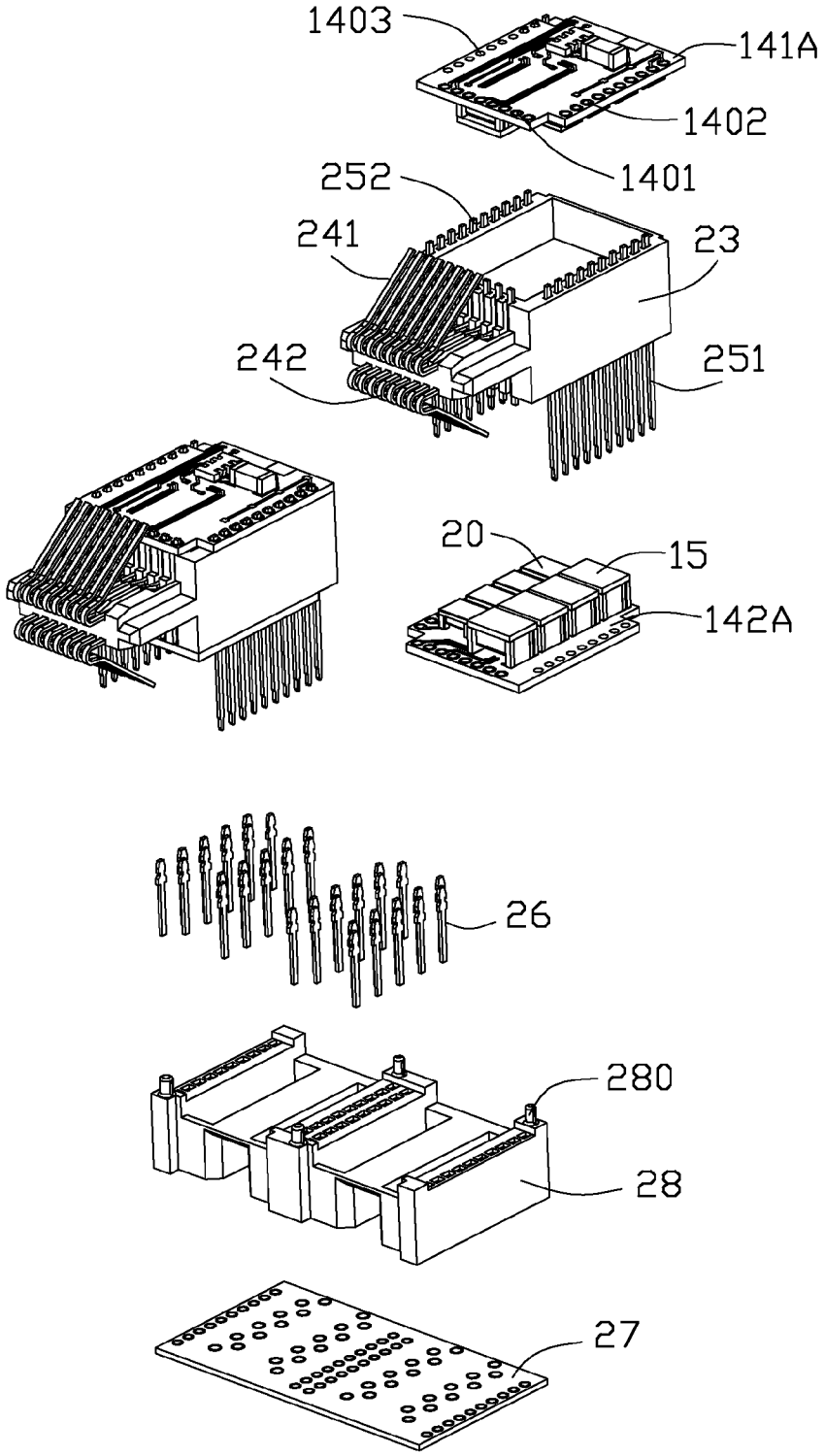
FIG. 4 is an exploded view of the terminal module in FIG. 3.
Figure 5:
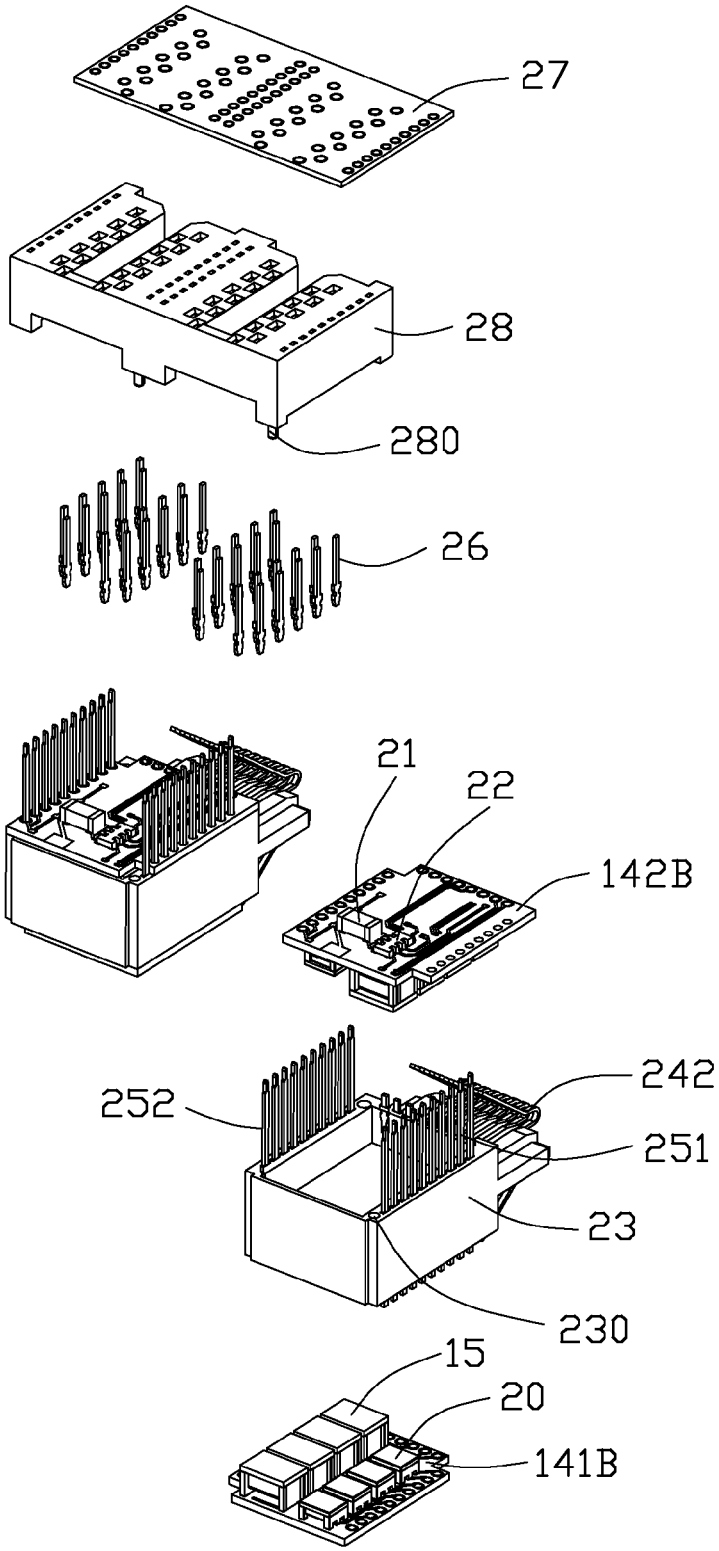
FIG. 5 is another exploded view of the terminal module in FIG. 4.
Figure 6:
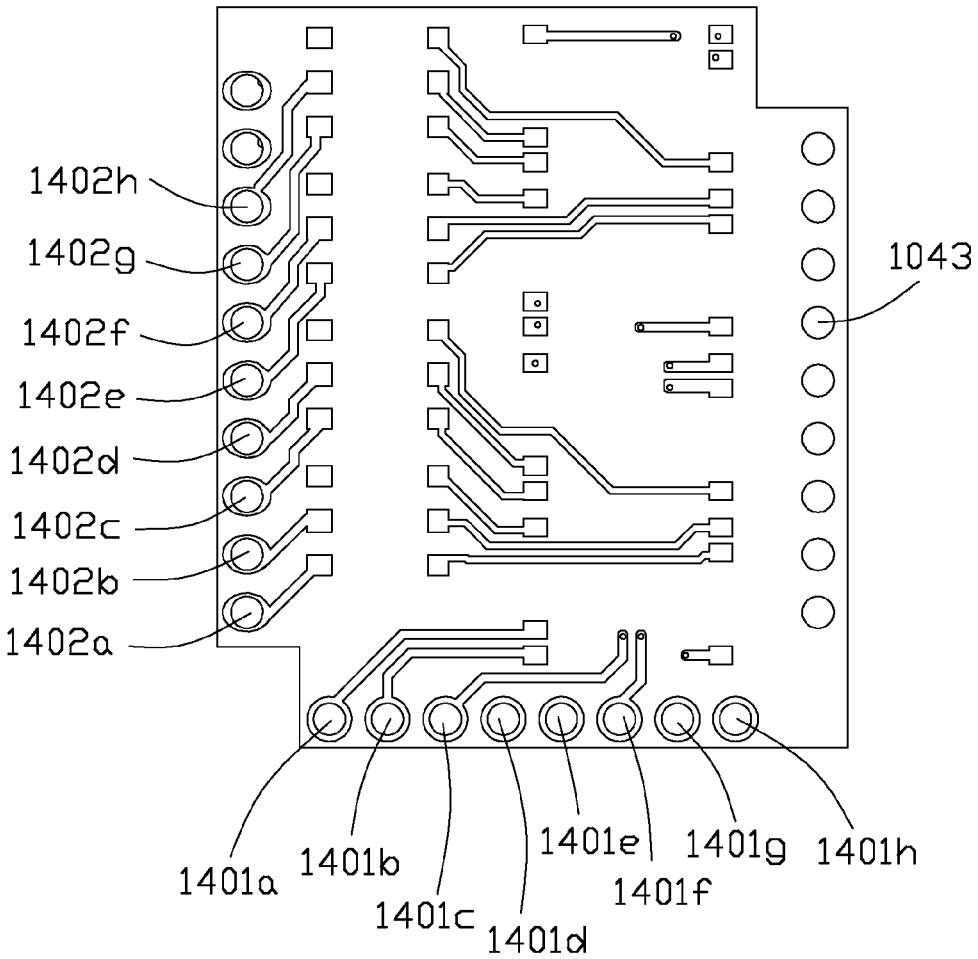
FIG. 6 is a front view of one surface of an inner circuit board in FIG. 4.
Figure 7:
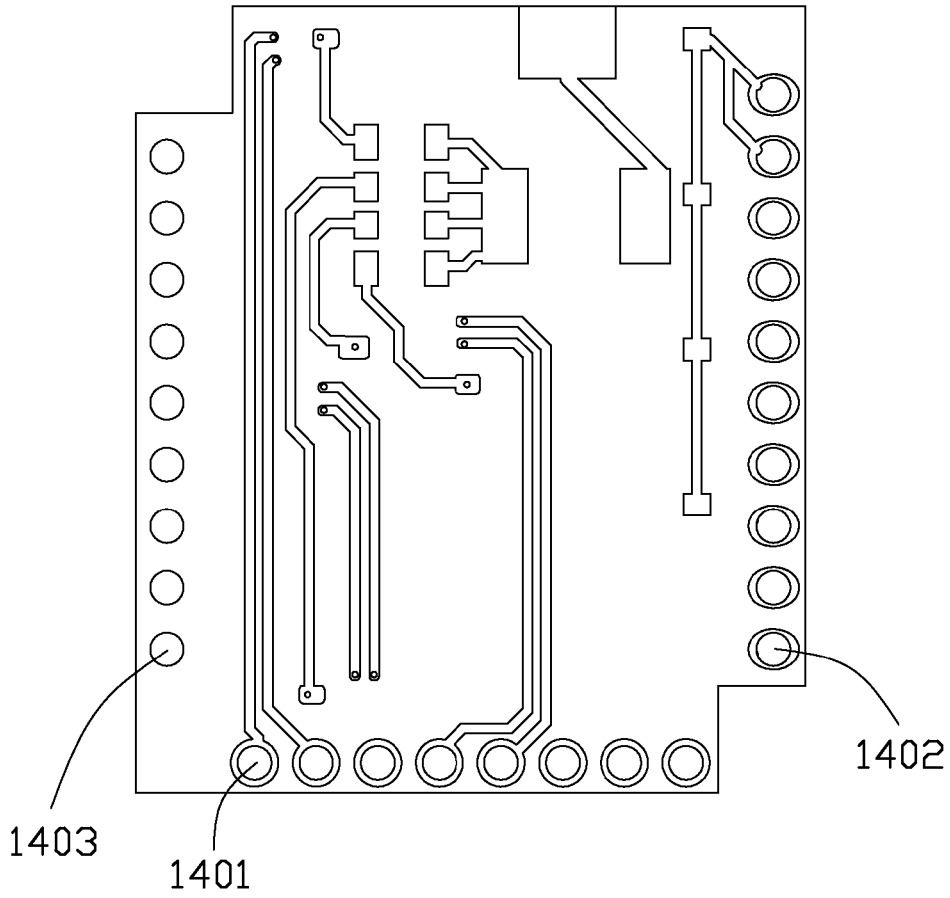
FIG. 7 is a front view of the other surface of the inner circuit board in FIG. 6.
Figure 8:
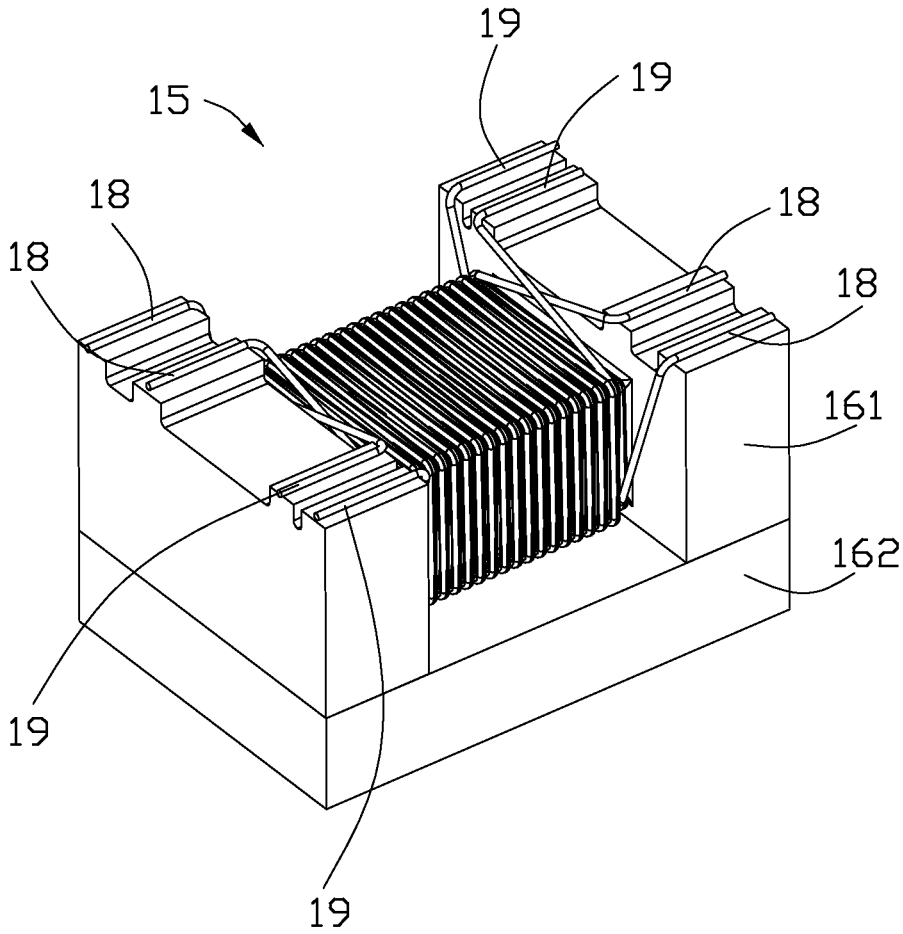
FIG. 8 is a perspective view of a transformer in FIG. 4.

FIGS. 1-2 show an electrical connector 10 used for being mounted onto an external circuit board. The electrical connector 10 includes a row of upper ports 131 and a row of lower ports 132 each used for receiving a plug along a longitudinal direction, the upper ports 131 and the lower ports 132 being aligned, each port including four differential signal channels. The electrical connector 10 includes an insulative housing 13, a plurality of terminal modules 14 received in the insulative housing 13, and a shell covering the insulative housing 13. The shell includes a front shell 11 and a rear shell 12, the front shell 11 cooperating with the rear shell 12 by a plurality of latching structures. Each upper port 131 and each lower port 132 aligned in a vertical direction share one terminal module 14.

FIGS. 3-11 show each terminal module 14 including a plurality pairs of mating terminals 24, a plurality pairs of foot terminals 26, and a circuit board component unit interconnecting said mating terminals 24 and said foot terminals 26, each pair of mating terminals 24 acting as an end of each differential signal channel, each pair of foot terminals 26 acting as the other end of each differential signal channel. The circuit board components include an upper inner circuit board 141 connected to the upper port 131, a lower inner circuit board 142 connected to the lower port 132, a bottom inner circuit board 27, and a plurality of electronic components mounted onto said upper inner circuit board 141 and lower inner circuit board 142, these three inner circuit boards all disposed along a horizontal direction and aligned in a vertical direction approximately. The terminal module 14 also includes a middle plastic portion 23 disposed between said upper inner circuit board 141 and said lower inner circuit board 142, and a positioning plastic portion 28 disposed between said lower inner circuit board 142 and said bottom inner circuit board 27. The upper inner circuit board 141 and lower inner circuit board 142 is a rectangular board, two corners of the lower inner circuit board 142 each having a gap in a diagonal line, the middle plastic portion 23 having two receiving holes 230 in the diagonal line, the positioning plastic portion 28 having two posts 280 in the diagonal line, said two posts 280 respectively received in said two receiving holes 230 in the gaps. The terminal module 14 also includes a plurality of connecting terminals 25 extending through the middle plastic portion 23 and the positioning plastic portion 28, the connecting terminals 25 connecting the upper inner circuit board 141 and lower inner circuit board 142 to the bottom inner circuit board 27. The foot terminals 26 extend downward from the bottom inner circuit board 27 to the external circuit board. The mating terminals 24 include a plurality of upper mating terminals 241 extending to the upper port 131 and a plurality of lower mating terminals 242 extending to the lower port 132. The upper mating terminals 241 and the lower mating terminals 242 are positioned by the middle plastic portion 23. The electronic components include a plurality of transformers 15 and a plurality of common mode filters 20. Each electrical signal channel includes a transformer 15 and a common mode filter 20. The upper inner circuit board 141 includes a upper surface 141A and a lower surface 141B, four transformers 15 and four common mode filters 20 disposed in the lower surface 141B and aligned along the longitudinal direction. The lower inner circuit board 142 includes a upper surface 142A and a lower surface 142B, four transformers 15 and four common mode filters 20 disposed in the upper surface 142A and aligned along the longitudinal direction. The transformers 15 include a first transformer 151, a second transformer 152, a third transformer 153, and a fourth transformer 154. The common mode filters 20 include a first common mode filter 201, a second common mode filter 202, a third common mode filter 203, and a fourth common mode filter 204. The common mode filters 20 are connected between said the transformer 15 and said foot terminals 26. The first transformer 151 and the first common mode filter 201 are connected to a first differential signal channel, the second transformer 152 and the second common mode filter 202 connected to a second differential signal channel, the third transformer 153 and the third common mode filter 203 connected to a third differential signal channel, the fourth transformer 154 and the fourth common mode filter 204 connected to a fourth differential signal channel.

FIGS. 8-11 show each transformer 15 including a drum type core 16, the drum type core 16 extending along a transverse direction perpendicular to the longitudinal direction in the inner circuit board, a primary winding wire 171 connected to one pair of said mating terminals 24, a secondary winding wire 172 connected to one pair of said foot terminals 26, the secondary winding wire 172 connected to the foot terminals 26 by the connecting terminals 25, that is, the secondary winding wire 172 connected to the upper inner circuit board 141 and the lower inner circuit board 142, the foot terminals 26 connected to the bottom inner circuit board 27, the upper inner circuit board 141 and the lower inner circuit board 142 connected to the bottom inner circuit board 27 by the connecting terminals 25. The drum type core 16 includes a core and first and second flanges disposed on both ends of the core, the primary winding wire 171 and the secondary winding wire 172 wound around the core, the first flange including a plurality of first protrusions, the second flange including a plurality of second protrusions, a plurality of first terminal electrodes each formed on respective surface of the first and second protrusions at a lateral side of the drum type core 16, the primary winding wire 171 including two ends 18 and an intermediate tap 19 each extending to the first terminal electrode, a plurality of second terminal electrodes each formed on respective surface of the first and second protrusions at the other lateral side of the drum type core 16, the secondary winding wire 172 including two ends 18 and an intermediate tap 19 each extending to the second terminal electrode. The primary winding wire 171 is connected to said inner circuit board by a plurality of first terminal electrodes, and the secondary winding wire 172 is connected to said inner circuit board by a plurality of second terminal electrodes. The drum type core 16 also includes a sheet-shaped core 162 covering the core and the first and second flanges. The two ends 18 of the primary winding wire 171 and the intermediate tap 19 of the secondary winding wire 172 extend to the first flange, while the two ends 18 of the secondary coil 172 and the intermediate tap 19 of the primary coil 171 extend to the second flange. That is, the two ends 18 and the intermediate tap 19 of the primary winding wire 171 are disposed in the first and second flanges at one lateral side of the drum type core 16, while the two ends 18 and the intermediate tap 19 of the secondary winding wire 172 are disposed in the first and second flanges at the other lateral side of the drum type core 16. The primary winding wire 171 corresponds to a high voltage area, and the secondary winding wire 172 corresponds to a low voltage area. The distance between the high voltage area and the low voltage area is at least 1.5 mm for avoiding electric discharge phenomena.

Figure 9:
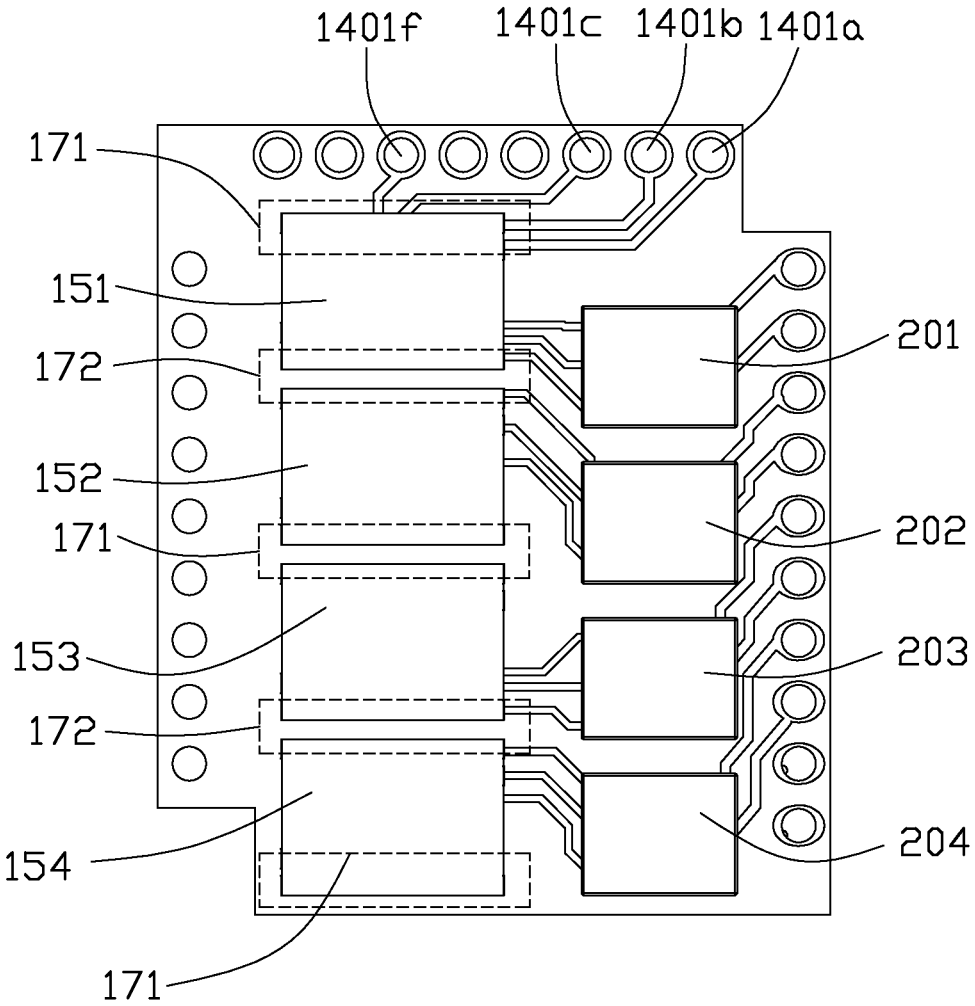
FIG. 9 is a front view of the inner circuit board, transformer and common mode filter in FIG. 4.
Figure 10:
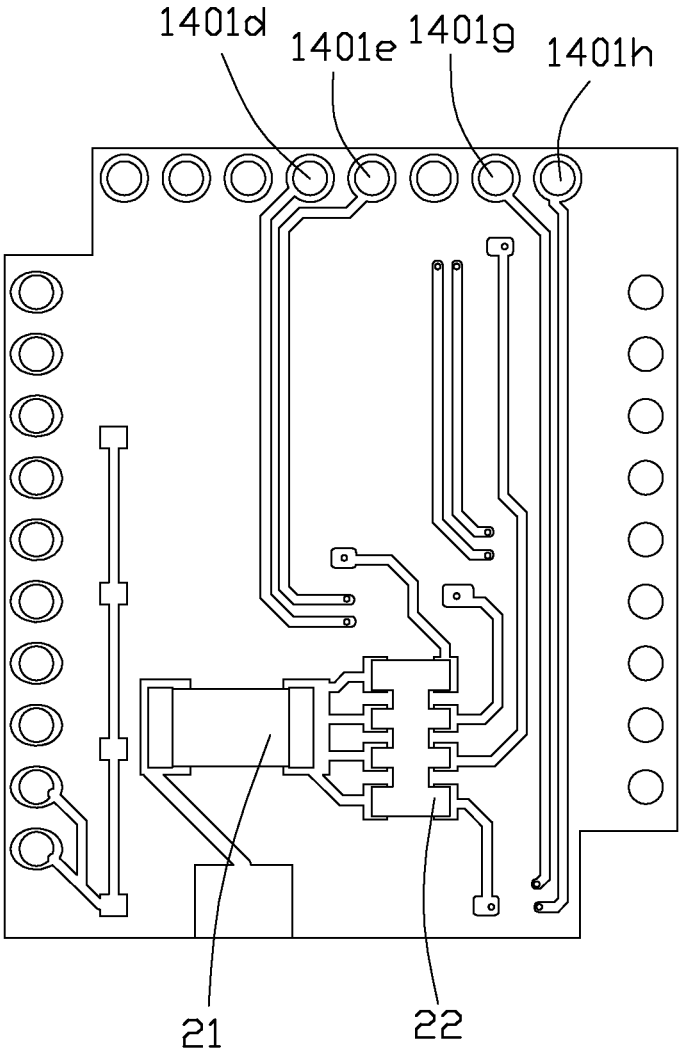
FIG. 10 is a front view of the inner circuit board, capacitor and resistor in FIG. 4.
Figure 11:
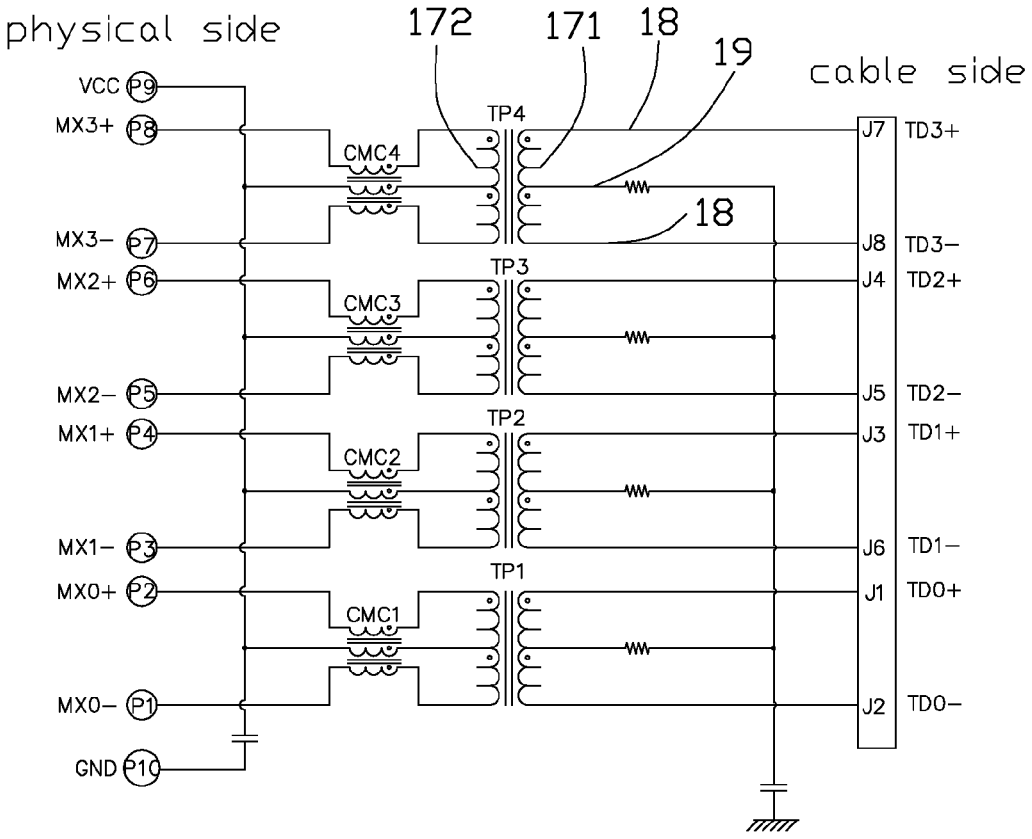
FIG. 11 is a circuit diagram of the electrical connector.

FIGS. 9-11 show the upper inner circuit board 141 including eight front connecting portions 1401 from a first front connecting portion 1401*a* to an eighth front connecting portion 1401*h* aligned in the front of the upper inner circuit board 141 along the transverse direction, eight side connecting portions 1402 aligned in one side of the upper inner circuit board 141 along the longitudinal direction, and a plurality of holes 1403 aligned in the opposite side of the upper inner circuit board 141. The lower inner circuit board 142 also includes eight front connecting portions 1401 from a first front connecting portion 1401*a* to an eighth front connecting portion 1401*h* aligned in the front of the lower inner circuit board 142 along the transverse direction, eight side connecting portions 1402 aligned in one side of the lower inner circuit board 142 along the longitudinal direction, and a plurality of holes 1403 aligned in the opposite side of the lower inner circuit board 142. The first front connecting portion 1401*a* is closer to said side connecting portions 1402 than other front connecting portions 1401. The first terminal electrodes of the first transformer 151 are disposed closer to said front connecting portions 1401 than the other transformers 15. The lower surface 141B of the upper inner circuit board 141 and the upper surface 142A of the lower inner circuit board 142 each includes four conductive channels respectively connected to the first front connecting portion 1401*a*, the second front connecting portion 1401*b*, the third front connecting portion 1401*c* and the sixth front connecting portion 1401*f*. The four conductive channels extend backward but not exceeding said first terminal electrode of the first transformer 151. The upper surface 141A of the upper inner circuit board 141 and the lower surface 142B of the lower inner circuit board 142 each includes two conductive channels respectively connected to the seventh front connecting portion 1401*g* and the eighth front connecting portion 1401*h*, said two conductive channels extending backward to the first terminal electrodes of the fourth transformer 154.

FIGS. 3-11 show the upper mating terminals 241 being connected to said front connecting portions 1401 of the upper inner circuit board 141, the lower mating terminals 242 being connected to said front connecting portions 1401 of the lower inner circuit board 142. The connecting terminals 26 are connected to said side connecting portions 1402. The side connecting portions 1402 of the upper inner circuit board 141 and the holes 1403 of the lower inner circuit board 142 are aligned in the vertical direction approximately. The holes 1403 of the upper inner circuit board 141 and the side connecting portions 1402 of the lower inner circuit board 142 are aligned in the vertical direction approximately. The connecting terminals include a plurality of first connecting terminals 251 and a plurality of second connecting terminals 252. The upper inner circuit board 141, the lower inner circuit board 142, and the bottom inner circuit board 27 each includes a plurality of conductive channels, traces, vias, or the like. The first connecting terminals 251 are connected to the side connecting portions 1402 of the upper inner circuit board 141 and extend downward from the upper inner circuit board 141. The first connecting terminals 251 extend through the holes 1403 of the lower inner circuit board 142. The first connecting terminals 251 each have a bottom end connected to the bottom inner circuit board 27. The foot terminals 26 are connected to the bottom inner circuit board 27 and extend downward from the bottom inner circuit board 27. The foot terminals 26 are used for connecting to the external circuit board. The electronic components of the upper inner circuit board 141 are connected to the first connecting terminals 251 by the conductive channels of the upper inner circuit board 141, and the first connecting terminals 251 are connected to the foot terminals 26 by the conductive channels of the bottom inner circuit board 27. The second connecting terminals 252 extend through the holes 1403 of the upper inner circuit board 141 and extend downward from the upper inner circuit board, the second connecting terminals being connected to the side connecting portions 1402 of the lower inner circuit board 142 and extending downward from the lower inner circuit board 142 to the bottom inner circuit board 27. Similarly, the second connecting terminals 252 each have a bottom end connected to the bottom inner circuit board 27. The foot terminals 26 are connected to the bottom inner circuit board 27 and extend downward from the bottom inner circuit board 27, the foot terminals 26 used for being connected to the external circuit board. The electronic components of the lower inner circuit board 142 are connected to the second connecting terminals 252 by the conductive channels of the lower inner circuit board 142, the second connecting terminals 252 connected to the foot terminals 26 by the conductive channels of the bottom inner circuit board 27.

FIGS. 4-11 show the electronic components also including a plurality of resistors 22 and a plurality of capacitors 21, four resistors 22 formed as a whole structure. The upper surface 141A of the upper inner circuit board 141 includes a capacitor 21 and four resistors 22, and the lower surface 142B of the lower inner circuit board 142 also includes a capacitor 21 and four resistors 22, one end of each resistor 22 respectively connected to the intermediate tap 19 of said primary winding wire 171 in each differential signal channel, the other end of the resistor 22 connected to a pole of the capacitor 21, the other pole of the capacitor 21 grounding. The four resistors 22 are disposed beside said capacitor 21, said capacitor 21 having a grounding pole, the grounding pole of the capacitor 21 disposed closer to said side connecting portions 1402 than said four resistors 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector having a plurality of differential signal channels, comprising:

plural pairs of mating terminals, each pair of mating terminals acting as an end of each differential signal channel, said mating terminals used for mating with a plug along a longitudinal direction;

plural pairs of foot terminals, each pair of foot terminals acting as the other end of each differential signal channel;

a plurality of circuit board component units interconnecting said mating terminals and said foot terminals, each circuit board component unit including an inner circuit board and a plurality of electronic components mounted onto the inner circuit board, said electronic components including a plurality of transformers; and each transformer including a drum type core, the drum type core including a core and first and second flanges disposed on both ends of the core, a primary winding wire and a secondary winding wire wound around the core, a plurality of first terminal electrodes each formed on respective surface of the first and second flanges at a lateral side of the drum type core, the primary winding wire including two ends and an intermediate tap each extending to the first terminal electrode, a plurality of second terminal electrodes each formed on respective surface of the first and second flanges at the other lateral side of the drum type core, the secondary winding wire including two ends and an intermediate tap each extending to the second terminal electrode, said transformers disposed in a first surface of the inner circuit board and aligned along the longitudinal direction, the drum type core extending along a transverse direction perpendicular to the longitudinal direction, either said first terminal electrodes of one transformer and said first terminal electrodes of an adjacent transformer or said second terminal electrodes of the one transformer and said second terminal electrodes of the adjacent transformer being disposed adjacent to each other.

2. The electrical connector as claimed in claim 1, including an insulative housing, said insulative housing including a front face and a port extending from the front face along the longitudinal direction, said inner circuit board disposed along a horizontal direction, the inner circuit board including a plurality of front connecting portions aligned in the front of the inner circuit board along the transverse direction and a plurality of side connecting portions aligned in the side of the inner circuit board along the longitudinal direction, said mating terminals connected to the first terminal electrodes by said front connecting portions, said foot terminals connected to the second terminal electrodes by said side connecting portions.

3. The electrical connector as claimed in claim 2, wherein said drum type core includes a sheet-shaped core covering the core.

4. The electrical connector as claimed in claim 3, wherein each port includes four differential signal channels, each differential signal channel including a common mode filter connected between said secondary winding wire and said foot terminals, said common mode filters disposed between said side connecting portions and said transformers.

5. The electrical connector as claimed in claim 4, wherein said side connecting portions include first through eighth side connecting portions, said front connecting portions including first through eighth front connecting portions, the first front connecting portion disposed closer to the side connecting portions than the other front connecting portions, the first and second side connecting portions connected to a first differential signal channel by the first and second front connecting portions, the third and fourth side connecting portions connected to a second differential signal channel by the third and fourth front connecting portions, the fifth and sixth side connecting portions connected a third differential signal channel by the fifth and sixth front connecting portions, the seventh and eighth side connecting portions connected to a fourth differential signal channel by the seventh and eighth front connecting portions.

6. The electrical connector as claimed in claim 5, wherein said transformers include first through fourth transformer, the first transformer connected to the first differential signal channel, the second transformer connected to the second differential signal channel, the third transformer connected to the third differential signal channel, the fourth transformer connected to the fourth differential signal channel, said first terminal electrodes of the first transformer disposed closer to said front connecting portions than the other transformers, the first surface of the inner circuit board including a plurality of conductive channels connected to at least a part of said front connecting portions, the plurality of conductive channels extending backward but not exceeding said first terminal electrodes of the first transformer.

7. The electrical connector as claimed in claim 6, wherein said inner circuit board includes a second surface opposite to the first surface, the second surface including two conductive channels connected to the seventh and eighth front connecting portions, said two conductive channels extending backward to the first terminal electrodes of the fourth transformer.

8. The electrical connector as claimed in claim 1, wherein the first flange includes a plurality of first protrusions, the second flange includes a plurality of second protrusions, the first terminal electrodes are formed on respective surfaces of the first and second protrusions at the lateral side of the drum type core, and the second terminal electrodes are formed on respective surfaces of the first and second protrusions at the other lateral side of the drum type core.

9. An electrical connector for being mounted onto an external circuit board, the electrical connector having a plurality of differential signal channels and including a row of upper ports and a row of lower ports, the electrical connector comprising:

an insulative housing having an opening for receiving a plug along a longitudinal direction; and a plurality of terminal modules received in the insulative housing, each terminal module including plural pairs of mating terminals, plural pairs of connecting terminals, plural pairs of foot terminals, and a plurality of circuit board component units, each of said circuit board component units including:

a horizontal upper inner circuit board, a horizontal lower inner circuit board, the connecting terminals connecting to the upper inner circuit board and the lower inner circuit board, and a plurality of electronic components mounted onto each inner circuit board, the electronic components including a plurality of surface mounted transformers, each surface mounted transformer including a primary winding wire connected to one pair of mating terminals and a secondary winding wire connected to one pair of connecting terminals, the circuit board component unit further including a bottom circuit board, the bottom circuit board connecting said one pair of connecting terminals to said one pair of foot terminals.

10. The electrical connector as claimed in claim 9, wherein each surface mounted transformer includes a drum type core, the drum type core including a core and first and second flanges disposed on both ends of the core, the primary winding wire and the secondary winding wire wound around the core, the first and second flanges each including a plurality of protrusions, a plurality of first terminal electrodes each formed on a respective surface of the protrusion, the primary winding wire including two ends and an intermediate tap each extending to the first terminal electrode, a plurality of second terminal electrodes each formed on a respective surface of the protrusion, the secondary winding wire including two ends and an intermediate tap each extending to the second terminal electrode.

11. The electrical connector as claimed in claim 10, wherein each inner circuit board includes a plurality of front connecting portions aligned in the front of the inner circuit board along a transverse direction perpendicular to the longitudinal direction and a plurality of side connecting portions aligned in the side of the inner circuit board along the longitudinal direction, said mating terminals connected to said first terminal electrodes by said front connecting portions, said foot terminals connected to said second terminal electrodes by said side connecting portions.

12. The electrical connector as claimed in claim 11, wherein said mating terminals include plural pairs of upper mating terminals and plural pairs of lower mating terminals, the circuit board component unit including an upper circuit board component unit and a lower circuit board component unit, a pair of upper mating terminals and a pair of upper circuit board component units connected to said upper port, a pair of lower mating terminals and a pair of lower circuit board component units connected to said lower port, said upper circuit board component unit and said lower circuit board component unit aligned in a vertical direction.

13. The electrical connector as claimed in claim 12, wherein the upper circuit board component unit includes an upper inner circuit board and a plurality of electronic components mounted onto the upper inner circuit board, the lower circuit board component unit includes a lower inner circuit board and a plurality of electronic components mounted onto the lower inner circuit board, each terminal module includes a middle plastic portion disposed between said upper circuit board component unit and said lower circuit board component unit, and said mating terminals and said connecting terminals are positioned in the middle plastic portion.

14. The electrical connector as claimed in claim 13, wherein said inner circuit board includes a plurality of holes disposed in the opposite side of the inner circuit board along the longitudinal direction, said connecting terminals extending through said holes.

15. The electrical connector as claimed in claim 14, wherein each terminal module includes a positioning plastic portion disposed between said lower circuit board and said bottom circuit board, said connecting terminals positioned by said positioning plastic portion.

16. The electrical connector as claimed in claim 15, wherein said inner circuit board is a rectangular board, at least one corner of the inner circuit board having a gap, said middle plastic portion cooperating with said positioning plastic portion through the gap.

17. The electrical connector as claimed in claim 16, wherein said electronic components include a plurality of common mode filters, each common mode filter disposed between said secondary winding wire of the surface mounted transformer and said side connecting portions.

18. An electrical connector comprising:

a printed circuit board; and a plurality of transformers side by side located upon the printed circuit board in one line along a transverse direction, each of said transformers including a center core with opposite first and second flanges at two opposite ends in a lengthwise direction perpendicular to said transverse direction, each of said first and second flanges defining opposite first and second side sections respectively located by opposite first and second sides of the center core in said transverse direction, a primary coil wound about the center core with two ends located at the first side sections of said first and second flanges, respectively, and a secondary coil would about the a center core with two ends located at the second side sections of said first and second flanges; wherein for each of said transformers, the ends of the corresponding primary coil neighbors with those of the primary coil of a neighboring transformers located by the first side of the corresponding center core, and the ends of the corresponding secondary coil neighbors with those of the secondary coil of a neighboring transformers located by the second side of the corresponding center core.

19. The electrical connector as claimed in claim 18, wherein the primary coil includes a differential pair of wires, and the secondary coil includes a differential pair of wires.

20. The electrical connector as claimed in claim 18, wherein the printed circuit board defines two opposite rows of through holes on two opposite side sections to have corresponding contacts extend therethrough, and one row of through holes are mechanically and electrically connected to the corresponding contacts while the other row of through holes are not.

* * * * *